United States Patent [19]

Sassmannshausen

[11] Patent Number: 4,890,209

[45] Date of Patent: Dec. 26, 1989

[54] SEARCHLIGHT, IN PARTICULAR A PORTABLE SEARCHLIGHT WITH AN ACCOMPANYING CURRENT SUPPLY

[76] Inventor: Kunt O. Sassmannshausen, Rothenbach Str., Idar-Oberstein, Fed. Rep. of Germany

[21] Appl. No.: 728,240

[22] Filed: Apr. 29, 1985

[30] Foreign Application Priority Data

Apr. 28, 1984 [DE] Fed. Rep. of Germany ..... 3415935

[51] Int. Cl.[4] ..... F21V 7/00

[52] U.S. Cl. ..... 362/348; 362/350

[58] Field of Search ..... 362/341, 347, 348, 350

[56] References Cited

U.S. PATENT DOCUMENTS 1,915,842 6/1933 Winkler ..... 362/348

4,277,821 7/1981 Sassmannshausen ..... 362/350

*Primary Examiner*—Noah P. Kamen

*Attorney, Agent, or Firm*—Herbert L. Lerner; Laurence A. Greenberg

[57] ABSTRACT

The invention relates to a searchlight, in particular a portable searchlight with an accompanying curruent supply. A device is disclosed by which the light of the searchlight can be homogenized, the range of the light beam not being adversely affected or only being adversely affected to a negligible extent by this device and, in a particularly advantageous embodiment of the invention, even being increased.

16 Claims, 1 Drawing Sheet

SEARCHLIGHT, IN PARTICULAR A PORTABLE SEARCHLIGHT WITH AN ACCOMPANYING CURRENT SUPPLY

BACKGROUND OF THE INVENTION

1. Field of the Invention

The invention relates to a searchlight, in particular a portable searchlight with an accompanying current supply.

2. Description of the Related Art

In searchlights of this type which as a rule have a parabolic concave reflector and an illuminant, the illuminant is generally disposed at the focal point of the concave mirror reflector in order to produce a light beam which is as parallel as possible and thus far reaching. Unfortunately there are natural limits to what can be achieved by this, since no source of light in the mathematical sense is available, which is a point source. All the known illuminants have a finite size, including for example those illuminants that are in the form of filament helices. This defined size of the illuminants lead to a slight fanning of the light beam and, in addition, to highly irregular light intensities inside the light beam.

This can result in individual parts of the illuminant, for example windings of the helices, being imaged in this light beam, so that an unsightly conglomerate of different windings of the illuminant can be discerned inside the light beam, if for example the latter is projected against a wall. A light beam of this type is unsuitable for the recognition of an object illuminated in this way, since the different light intensities inside the light beam at least partially blur the contours of an object illuminated in this way. In addition, a light beam of this type appears unsightly.

It is known to homogenize the light intensities inside a light beam of this type by making the reflecting surface of the concave mirror reflector grained. Such a surface often resembles the surface of an orange peel. Unfortunately the concentration of the light beam is adversely affected by these steps for homogenizing the light intensity and the range of such homogenized light beams is inadequate.

SUMMARY OF THE INVENTION

The object of the present invention is to disclose ways in which an homogenization of the light intensities inside the light beam can be attained, without pronounced fanning of the light beam occurring and thereby considerably reducing the range of the light beam.

In an extensive series of tests the inventor has found that in practice there is a close relationship between the profile of a concave mirror reflector and the illuminant of the light source and that the deviations on the reflecting surface of the concave mirror reflector must be brought into a specific relationship with the profile of the concave mirror reflector in a specific manner, in order to achieve an homogenization of the light beam in such a way that the illuminating widths of the light beam are not adversely affected or only slightly adversely affected.

This object is attained according to the invention by a searchlight, in particular a portable searchlight having an accompanying current supply with an illuminant in the form of a wire filament as a light source and a concave mirror reflector, which comprises a focal area in which the reflecting surface of the concave mirror reflector deviates from the mathematical shape of a paraboloid and in which the mean distance of the individual windings of the illuminant from one another amounts to less than twice the diameter of the filament and in which the reflecting surface of the concave mirror reflector has deviations in the form of spherical segments, the maximum extent of which at right angles to their radius amounts to between 25 and 60 percent of the square root of the distance of the center of the focal area to the apex of the concave mirror reflector and in which the radius of the spherical segments is as great as the maximum distance between two points of the coiled portion of the illuminant multiplied by a factor of between 18 and 45 divided by the square root of the distance of the center of the focal area to the apex of the concave mirror reflector.

The solution of the object of the invention is to be described in greater detail in the following. In the case of a parabolic concave mirror reflector reference is normally made to a focal point, but instead the term "focal area" has been selected since the described concave mirror reflector according to the invention has specific deviations from the mathematical shape of a paraboloid. In this way a focal area is produced instead of a focal point, as a result of which, according to the invention, the special conditions of an illuminant of finite size are met. The center of this focal area is used to define the distance from this center, which would normally correspond to the focal point of the concave mirror reflector, to the apex of the concave mirror reflector. In this connection reference is made to the fact that this dimension represents the theoretical mathematical vertex of the concave mirror reflector, because in practice the vertex frequently does not exist since in the area of its apex the concave mirror reflector has an opening through which an incandescent lamp can be inserted into the concave mirror reflector. The term "apex" of the concave mirror reflector thus refers to the theoretical mathematical apex. In the case of the distance of the individual windings of the illuminant from one another I have referred to the mean distance, since such illuminants are frequently arranged in a slightly curved manner, as a result of which the diameter of the windings on the inside of the curved helix is somewhat smaller than the diameter on the outside of the curved winding. The mean distance between the windings is then in practice at approximately half the diameter of the helical tube formed by the helic.

The feature disclosed for attaining the solution of the object of the invention requires that the mean distance of the individual windings of the illuminant from one another should be less than twice the diameter of the filament. According to the invention, however, far between results are attained if the mean distance between the individual windings of the illuminant is less than the diameter of the radiant part of the filament. The deviations formed on the reflecting surface of the concave mirror reflector should be in the form, for example, of spherical segments, which can be used without departing from the inventive concept. The maximum extent of the surface segment measured at right angles to its radius refers to the extent of the surface measured from the base of the radius to the spherical segment, and the radius should meet the spherical segment at its center. One of the main features, according to the invention relates to the maximum extent of a surface segment measured at right angles to this radius. The maximum distance between two points on the coiled part of the illuminant represents the diameter of a theoretical sphere, which surrounds the coiled part of the illuminant.

Even better results are obtained when the maximum extent of the spherical segments measured at right angles to their radius is between 30 percent and 50 percent of the square root of the distance between the center of the focal area and the apex of the concave mirror reflector. In other words, the maximum extent of the spherical segments measured at right angles to their radius, i.e. at the base of the radius, should amount to between 30 percent and 50 percent of the square root or the distance from the focal area of the concave mirror reflector to its apex.

In a partially advantageous embodiment of the invention the radius of the spherical segments is as great as the maximum distance between two points on the coiled portion of the illuminant multiplied by a factor of between 25 and 35 and then divided by [the] square root of the distance between the center of the focal area (focal point) and the apex of the concave mirror reflector. In a further advantageous embodiment of the invention less than 80 percent of the reflecting surface of the concave mirror reflector has deviations in the form of spherical segments.

Particularly high light intensities are obtained when, according to invention, less than 70 percent of the reflecting surface of the concave mirror reflector has deviations in the form of spherical segments.

In many cases it is necessary both from a manufacturing point of view and in order to prevent vibrations of illuminants, that the mean distance between the individual windings of he illuminant amounts to more than twice the diameter of the radiating filament. Alternatively, in these cases, a high light intensity with simultaneous homogenization of the light beam can be achieved with the inventive features set out below:

A searchlight, in particular a portable searchlight with an accompanying current supply with an illuminant formed as a helical wire filament serving as a light source and a concave mirror reflector which comprises a focal area and in which the reflecting surface of the concave mirror reflector has deviations from the mathematical shape of a cylindrical paraboloid having an axis and an apex. In the helix the mean distance between the individual windings of the illuminant amounts to more than twice the diameter of the radiant filament, and the reflecting surface of the concave mirror reflector has deviations in the form of spherical segments whose maximum extent measured at right angles to their radius amounts to between 25 percent and 60 percent of the square root of the distance between the center of the focal area (focal point) and the apex of the concave mirror reflector and in which the radius of these spherical segments is as great as the maximum distance between two points on the coiled portion of the illuminant, multiplied by a factor being between 10 and 20 divided by the square root of the distance between the center of the focal area and the apex of the concave mirror reflector.

Even better results are obtained if, according to the invention, the maximum extent of the spherical segments measured at right angles to their radius amounts to between 30 percent and 50 percent of the square root of the distance between the center of the focal area (focal point) and the apex of the concave mirror reflector.

The radius of the spherical segment is advantageously as great as the maximum distance between two points on the coiled portion of the illuminant multiplied by a factor of between 12 and 17 and then divided by the square root of the distance between the centre of the focal area (focal point) and the apex of the concave mirror reflector.

In a further advantageous embodiment of the invention less than 80 percent of the reflecting surface of the concave mirror reflector has deviations in the form of spherical segments.

Particularly high light intensities are obtained if even less than 70 percent of the reflecting surface of the concave mirror reflector has deviations in the form of spherical segments.

A further alternative embodiment of the invention, is a searchlight, in particular a portable searchlight, having an accompanying current supply having an illuminant as a light source and a concave mirror reflector, which comprises a focal area and wherein the reflecting surface of the concave mirror reflector has deviations from the mathematical shape of a paraboloid, and wherein the deviations are shaped in the form of spherical segments whose maximum extent measured at right angles to their radius is between 25 percent and 60 percent of the square root of the distance between the center of the focal area (focal point) and the apex of the concave mirror reflector and wherein the radius of the spherical segments is as great as the square root of the distance between the centre of the focal area (focal point) and the apex of the concave mirror reflector multiplied by a factor being between 3.5 and 7, multiplied by the maximum extent of the spherical segments measured at right angles to their respective radius.

With this arrangement of the concave mirror reflector according to the invention, particularly good illumination results can be obtained, and the light is thus excellently homogenized, but nevertheless retains a very high degree of focussing.

In a further advantageous embodiment of the invention of the last-described concave mirror reflector, the maximum extent of the spherical segments measured at right angles to their radius amounts to between 30 percent and 50 percent of the square root of the distance of the center between the focal area (focal point) and the apex of the concave mirror reflector.

An embodiment is also particularly advantageous in which the radius of these spherical segments is as great as the square root of the distance between the center of the focal area (focal point) and the apex of the concave mirror reflector multiplied by a factor being between 4 and 6 and then multiplied by the maximum extent of the spherical segments at right angles to their radius.

It is advantageous for less than 80 percent of the reflecting surface of the concave mirror reflector to have deviations in the form of spherical segments.

Particularly good illumination results are obtained if, according to the invention, less than 65 percent of the reflecting surface of the concave mirror reflector has deviations in the form of spherical segments.

The best result of all are obtained if, according to the invention, the entire reflecting surface of the concave mirror reflector including the deviations in the form of spherical segments is made smooth and is highly polished. (This refers to the high polish of the tool in the case of reflectors of plastics material.) This ensures that other than in the case of an optionally grained surface only those light results which are sought are obtained with this searchlight according to the invention. For this purpose, according to the invention the surface of the reflecting portion of the concave mirror reflector should be absolutely smooth and shiny before mirror coating, namely on the surfaces which are in the form of spherical segments.

The object of the present invention is therefore not only simply to homogenize the light beam cast by the searchlight but also to emit this light highly focussed by an entirely defined placement of the means for homogenizing.

The invention is particularly well suited for small searchlights in which the distance between the center of the focal area (focal point) and the apex of the concave mirror reflector is between 2 mm and 20 mm in size. It need not, however, be limited to these searchlight dimensions. The calculation of the data of the searchlight is based on values stated in millimeters.

Other features which are considered as characteristic for the invention are set forth in the appended claims.

Although the invention is illustrated and described herein as embodied in a searchlight, in particular a portable searchlight with an accompanying current supply, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing in which one embodiment of the invention is illustrated diagrammatically.

BRIEF DESCRIPTION OF THE DRAWING

The single FIGURE of the drawing shows a searchlight according to the invention in a fragmentary view which is only diagrammatic and which has been enlarged in a ratio of 5:1.

DESCRIPTION OF THE PREFERRED EMBODIMENTS

Figure 1:
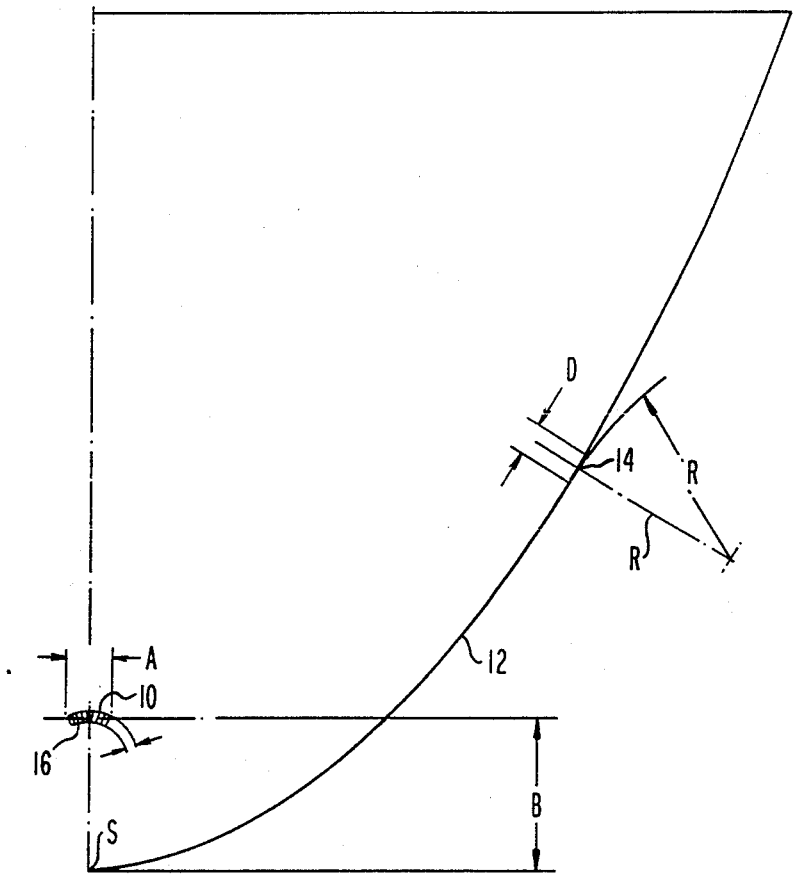

The concave mirror reflector 12 of the searchlight is provided on its reflecting surface with very shallow spherical segments according to the invention, of which only one spherical segment 14, is illustrated in the diagrammatic drawings. At right angles to its radius R (in this case passing through the center of spherical segments) it has an extent D at its base. The (theoretical) vertex of the concave mirror reflector 12 is shown at S. The center of the focal area, which could also be referred to as the focal point of the concave mirror reflector 12, is located at 16. The distance between the center 16 of the focal area and the apex S of the concave mirror reflector 12 is designated B. The maximum distance of two points on the coiled portion of the illuminant 10 is designated A.

The drawing is, as indicated above, only diagrammatic, the scale being 5:1.

I claim:

1. A searchlight including an accompanying current supply, an illuminant having a coiled portion wound from wire filament serving as a light source a concave mirror reflector having an axis and an apex therein, and a focal area and wherein the reflecting surface of the concave mirror reflector has deviations from the mathematical shape of a paraboloid, comprising individual windings of the illuminant wherein the mean distance therebetween is less than twice the diameter of the filament, the deviations in the reflecting surface of the concave mirror reflector being in the form of spherical segments, the maximum extent of which measured at right angles to their respective radii, are between 25 and 60 percent of the square root of the distance of the center of the focal area and the apex of the concave mirror reflector, and the radii of the respective spherical segments being no greater than the maximum distance between two points on the coiled portion of the illuminant, multiplied by a factor being between 18 and 45 divided by the square root of the distance between the center of the focal area and the apex of the concave mirror reflector.

2. A searchlight according to claim 1, wherein the maximum extent of the spherical segments measured at right angles to their respective radii is between 30 percent and 50 percent of the square root of the distance between the center of the focal area and the apex of the concave mirror reflector.

3. A searchlight according to claim 1, wherein the radius of the spherical segments is no greater than the maximum distance between two points on the coiled portion of the illuminant multiplied by a factor being between 25 and 35 and divided by the square root of the distance between the center of the focal area and the apex of the concave mirror reflector.

4. A searchlight according to claim 1, wherein the deviations include less than 80 percent of the reflecting surface of the concave mirror reflector, and are in the form of spherical segments.

5. A searchlight according to claim 1, wherein the entire reflecting surface of the concave mirror reflector including the deviations are in the form of spherical segments that are absolutely smooth and shiny before mirror coating.

6. A searchlight according to claim 4, wherein the deviations include less than 70 percent of the reflecting surface of the concave mirror reflector and are in the form of spherical segments.

7. A searchlight, including an accompanying current supply with an illuminant having a coiled portion wound from wire filament serving as a light source, and a concave mirror reflector having an axis and an apex therein, and focal area, wherein the reflecting surface of the concave mirror reflector has deviations from the mathematical shape of a paraboloid, comprising individual windings of the illuminant wherein the mean distance between the windings is no greater than twice the diameter of the illuminant filament, said deviations being in the form of spherical segments whose maximum extent measured at right angles to their radii are between 25 percent and 60 percent of the square root of the distance between the center of the focal area and the apex of the concave mirror reflector, and the radii of the respective spherical segments are no greater than the maximum distance between two points on the coiled portion of the illuminant multiplied by a factor being between 10 and 20 divided by the square root of the distance between the center of the focal area and the apex of the concave mirror reflector.

8. A searchlight to claim 7, wherein the maximum extent of the spherical segments measured at right angles to their respective radii are between 30 percent and 50 percent of the square root of the distance between the center of the focal area and the apex of the concave mirror reflector.

9. A searchlight according to claim 7 wherein the radii of the respective spherical segments are no greater than the maximum distance between two points on the coiled portion of the illuminant multiplied by a factor of being 12 and 17 divided by the square root of the distance between the center of the focal area and the apex of the concave mirror reflector.

10. A searchlight according to claim 7, wherein said deviations include less than 80 percent of the reflecting surface of the concave mirror reflector.

11. A searchlight according to claim 7, wherein said deviations include less than 70 percent of the reflecting surface of the concave mirror reflector.

12. A searchlight, including an accompanying current supply comprising an illuminant as a light source and a concave mirror reflector, which includes a focal area, deviations included in the reflecting surface of the concave mirror reflector, said deviations deviating from the mathematical shape of a paraboloid, said deviations being in the form of spherical segments whose maximum extent measured at right angles to their respective radii are between 25 percent and 60 percent of the square root of the distance between the center of the focal area and the apex of the concave mirror reflector, and the radius of said spherical segments being no greater than the square root of the distance between the center of the focal area and the apex of the concave mirror reflector, multiplied by a factor being between 3.5 and 7, multiplied by the maximum extent of the spherical segments measured at right angles to their respective radii.

13. A searchlight according to claim 12, wherein the maximum extent of the spherical segments measured at right angles to their respective radii are between 30 percent and 50 percent of the square root of the distance between the center of the focal area and the apex of the concave mirror reflector.

14. A search light according to claim 12 wherein the radii of said spherical segments is no greater than the square root of the distance between the center of the focal area and the apex of the concave mirror reflector multiplied by a factor being between 4 and 6 and multiplied by the maximum extent of the spherical segments measured at right angles to their respective radii.

15. A searchlight according to claim 12, wherein less than 80 percent of the reflecting surface of the concave mirror reflector has deviations.

16. A searchlight according to claim 15, wherein less than 65 percent of the reflecting surface of the concave mirror reflector has deviations in the form of spherical segments.

* * * * *